United States Patent [19]

Eheim

[11] 4,407,249

[45] Oct. 4, 1983

[54] FUEL INJECTION PUMP FOR SELF-IGNITING INTERNAL COMBUSTION ENGINES

[75] Inventor: Franz Eheim, Stuttgart, Fed. Rep. of Germany

[73] Assignee: Robert Bosch GmbH, Stuttgart, Fed. Rep. of Germany

[21] Appl. No.: 260,957

[22] Filed: May 6, 1981

[30] Foreign Application Priority Data

May 6, 1980 [DE] Fed. Rep. of Germany ..... 2017275

[51] Int. Cl.[3] ..... F02M 41/00

[52] U.S. Cl. ..... 123/449; 123/450; 123/511

[58] Field of Search ..... 123/449, 450, 458, 459, 123/511, 512

[56] References Cited

U.S. PATENT DOCUMENTS

| | | | |
|---|---|---|---|
| 2,110,405 | 3/1938 | Starr | 123/450 |
| 2,673,662 | 3/1954 | Bensinger | 123/450 |
| 3,107,661 | 10/1963 | Kemp | 123/449 |
| 3,439,624 | 4/1969 | Glikin et al. | 123/450 |
| 3,547,092 | 12/1970 | Knight | 123/450 |
| 3,615,043 | 10/1971 | Hussey et al. | 123/450 |
| 3,777,731 | 12/1975 | Kobayashi et al. | 123/449 |
| 3,841,286 | 10/1974 | Eheim | 123/338 |
| 3,896,779 | 7/1975 | Omori et al. | 123/449 |
| 4,073,276 | 2/1978 | Nicolls | 123/450 |
| 4,187,822 | 2/1980 | Craven et al. | 123/450 |

FOREIGN PATENT DOCUMENTS

| | | | |
|---|---|---|---|
| 2503355 | 7/1976 | Fed. Rep. of Germany | 123/449 |
| 703044 | 12/1979 | U.S.S.R. | 123/449 |

*Primary Examiner*—Ira S. Lazarus
*Assistant Examiner*—Magdalen Moy
*Attorney, Agent, or Firm*—Edwin E. Greigg

[57] ABSTRACT

A fuel injection pump for self-igniting internal combustion engines is proposed in which a metering piston operates synchronously with the engine and a distributor operates synchronously with a pump piston. During the intake stroke of the pump piston the distributor delivers a metered injection quantity to a work chamber associated with the pump piston, and during the compression stroke of the pump piston the metered injection quantity is distributed through injection lines to the engine injection nozzles. The metering piston is disposed upstream of the distributor so that high pressure conditions do not deleteriously effect the fuel metering. The stroke of the metering piston is adjusted electrically and controlled by a microprocessor unit to which engine operating characteristics are supplied.

6 Claims, 6 Drawing Figures

FUEL INJECTION PUMP FOR SELF-IGNITING INTERNAL COMBUSTION ENGINES

BACKGROUND OF THE INVENTION

The invention is directed to a fuel injection pump having a metering piston operating synchronously with the engine and a distributor operating synchronously with a pump piston. In known fuel injection pumps of this type, the stroke of the metering piston is varied by means of stops which are adjustable in accordance with load. As a result, it is not possible to adapt the injection characteristic to the engine manufacturer's precise requirements for exhaust gas detoxification and other procedures which are dependent on engine characteristics.

OBJECT AND SUMMARY OF THE INVENTION

It is an object of the fuel injection pump according to the invention to provide a principle of injection which can be adapted to various engine characteristics in order to satisfy the requirements made by engine manufacturers.

It is another object of the invention to provide a structure wherein the metering piston is disposed upstream of the distributor, so that pressure conditions in the high-pressure system do not have a deleterious effect on fuel metering.

The invention will be better understood and further objects and advantages thereof will become more apparent from the ensuing detailed description of two preferred embodiments taken in conjunction with the drawing.

DESCRIPTION OF THE PREFERRED EMBODIMENTS

Figure 1:
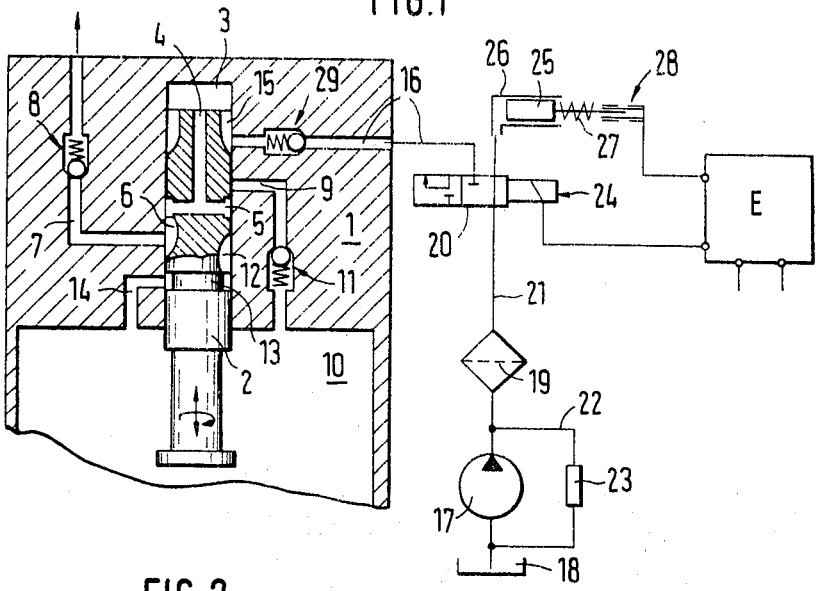
FIG. 1 shows a partial section through a first embodiment of the fuel injection pump according to the invention showing schematically other elements to which it is connected.

In the first exemplary embodiment shown in FIG. 1, a pumping and distributor piston 2 operates within a housing 1 of a fuel injection pump. The pump piston 2 is subject simultaneous rotary and reciprocating movement by means not shown. During its compression stroke, that is, after executing an upward movement, the pump piston 2 supplies fuel from the pump work chamber 3 to a pressure line 7 via at least one bore 4 communicating the work chamber with an annular groove 5 disposed in the jacket face, and with a longitudinal distributor groove 6. A check valve 8 is disposed in the pressure line 7, and the pressure line 7 leads to the engine and to the injection nozzles disposed on the engine.

There are as many pressure lines 7 as there are cylinders of the engine being supplied with fuel, although for reasons of space only one of these pressure lines 7 is actually shown in the drawing. Toward the end of the compression stroke, the annular groove 5 communicates with a bore 9 extending within the housing 1. The bore 9 leads into a suction chamber 10 of the injection pump, and a check valve 11 is disposed in the bore 9; communication of the bore 9 with the annular groove 5 interrupts the injection, returning excess fuel to the suction chamber 10.

Upon further rotation of the distributor 2, the pressure line 7 is then relieved of pressure toward the suction chamber, or the pressure in the pressure line 7, up to the check valve 8, is equalized to that in the suction chamber. This relief of pressure is effected via communication of a longitudinal groove 12, an annular groove 13 and a bore 14 extending within the housing with the suction chamber 10. During the intake stroke of the pump piston 2, that is, upon downward movement, the pump work chamber 3 is supplied with fuel from a supply pump 17 via an intake line 6 by way of one of the longitudinal grooves 15 disposed in the pump piston 2. The supply pump 17 aspirates fuel from a tank 18 and delivers it via a filter 19 to a magnetic valve 20. A line 22 branches off from the pressure line 21 of this supply pump 17 and returns to the container 18. A pressure control valve 23 is disposed in line 22. The valve 20 comprises a 3/2-way valve which is switched by means of an electro-magnet 24. In the position illustrated in FIG. 1, the intake line 16 is closed to communication with the pump work chamber 3, while the line 21 is opened to feed a metering piston 25. This position is assumed during the compression stroke of the pump piston 2. As a result of the fuel under pressure from the supply pump 17, which pressure is controlled by the pressure control valve 23, the metering piston 25 is displaced within an associated cylinder 26 counter to the force of a restoring spring 27. The distance traveled by the piston 25 is measured by a transducer 28, which is connected with an electronic control device E having an injection program stored in its memory. In accordance with other engine characteristics, the magnetic valve 20, 24 is then switched over after the required stroke distance has been traveled-that is, after the quantity of fuel to be injected has been metered. Upon the reversal of the magnetic valve 20, 24, a connection is established between the metering piston 25 and the intake line 16. The pressure line 21 of the supply pump 17 is then closed, so that additional supplied fuel flows back to the tank 18 via the pressure control valve 23. Then as soon as the pump piston 2 begins its intake stroke, and the longitudinal groove 15 opens the intake line 16, the metered quantity of fuel flows into the pump work chamber 3. In order to permit fuel flow only in the intake direction, a check valve 29 is disposed in the intake line 16.

Because of the electrical regulation of the fuel metering, it is possible to adapt the injection characteristic very precisely to engine requirements, while making use of various conceivable engine characteristics, whose actual value is measured via appropriate transducers, as input which is converted for injection purposes in accordance with the program stored in the electronic control device E. In this manner, it is possible not only to effect the determination of injection quantity as described above, but also to actuate the injection onset converter and other converters of the injection pump or injection system.

Figure 2:
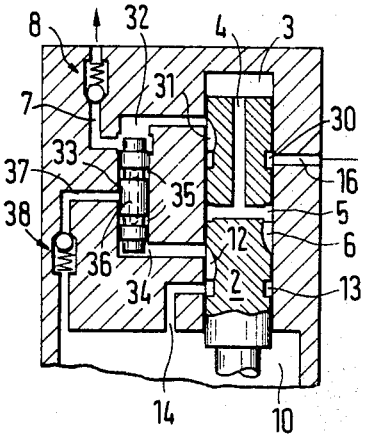
FIG. 2 shows a partial sectional view of a variant upon the embodiment of FIG. 1.

In the variant of this first exemplary embodiment shown in FIG. 2, the fuel is delivered by the metering device 25, 26 through the intake line 16 not into the pump work chamber 3 but rather into a work chamber 32 of an intermediate piston 33 via an annular groove 30 and a longitudinal distributor groove 31 provided in the pump piston 2. The intermediate piston 33 is provided with a chamber 34 located on its opposite side which can be made to communicate with the pump work chamber 3 via the longitudinal distributor groove 6 and bores 4 or the annular groove 5. In the illustrated position, this chamber 34 communicates with the suction chamber 10 via the longitudinal groove 12 and the annular groove 13 or the relief channel 14. There are as many intermediate pistons 33 as there are pressure lines 7. Annular grooves 35 are provided on the intermediate piston 33 and are interconnected by means of a longitudinal bore 36. In the upper terminal position of the intermediate piston 33, the pressure line 7 is made to communicate with a relief conduit 37 by way of the annular grooves 35. In order to maintain pressure, a check valve 38 is disposed in this relief conduit 37. In accordance with this variant embodiment, the work chamber 32 of the intermediate piston 33 is supplied with metered fuel from the intake line 16 during the intake stroke of the pump piston 2. After the intake stroke is terminated and the longitudinal groove 31 is separated from the work chamber 32 upon further rotation during the subsequent compression stroke, the metered fuel is displaced upward causing the metered quantity of fuel previously stored there to flow into the pressure line 7. During this supply procedure, the pump work chamber 3 is made to communicate with the chamber 34 via the bores 4, the annular groove 5 and the distributor groove 6. The pressure in the intake line 16 is always greater than the pressure in the suction chamber 10, so that when the work chamber 32 is being filled the intermediate piston 33 is in fact displaced. The piston 33 assumes an intermediate position which corresponds to the metered fuel quantity and does not travel as far as its lower stop, which could cause sufficient fuel aspiration as to empty the intake line 16.

Figure 3:
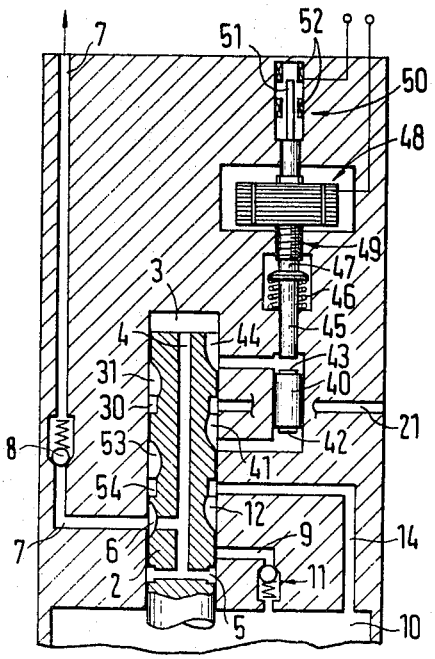
FIG. 3 shows a partial sectional view of a second embodiment of the fuel injection pump following the invention.

In the second exemplary embodiment shown in FIG. 3, an intermediate piston 40 is provided as the metering piston. The pressure line 21 of the supply pump 17 discharges directly into the annular groove 30 in this case, which groove 30 distributes the fuel alternately to the two extremities 42, 43 of the intermediate piston 40 via a first longitudinal distributor groove 31 or a second longitudinal distributor groove 41. During the intake stroke of the pump piston 2, the fuel flows via the longitudinal groove 41 to the extremity 42 of the intermediate piston 40, displacing the latter upward, whereupon the intermediate piston 40 delivers the fuel located adjacent to the extremity 43 to the pump work chamber 3 via a longitudinal groove 44 disposed in the distributor piston 2. The fuel supply quantity and accordingly the injection quantity are determined by a stop 45, which is displaced by a spring 46 against the shaft 47 of a servomotor 48. The shaft 47 of the servomotor is provided with a threaded portion 49 extending within the pump housing, so that a rotation of the servomotor causes a corresponding axial displacement of the shaft 47 and thus of the stop 45. This axial displacement is measured via a transducer 50. A tang 51 of the shaft 47, acting as an armature, protrudes within the transducer 50 and its position can be measured by two magnetic coils 52. During the intake stroke, the pressure line 7 of the injection pump is relieved of pressure toward the suction chamber 10 via the longitudinal groove 12 and the bore 14. During the subsequent compression stroke of the pump piston 2, the longitudinal groove 44 is separated from communication with the metering piston and the fuel is delivered out of the pump work chamber 3 into the pressure line 7 via the longitudinal bore 4 and the distributor groove 6. Toward the end of the compression stroke, the relief conduit 9 is opened by the annular groove, and the injection is thereby terminated. During the compression stroke, the chamber adjacent to the extremity 42 of the metering piston 40 is additionally connected with the relief bore 14 via a longitudinal groove 53 in the pump piston and via an annular groove 54. As a result, the fuel delivered from the pressure line 21 of the supply pump by way of the grooves 30, 31 is capable of displacing the metering piston 40 into a lower outset position.

In contrast to the first exemplary embodiment, the metering piston in the second exemplary embodiment is capable of being actuated in two directions by the supply pump.

Figure 4:
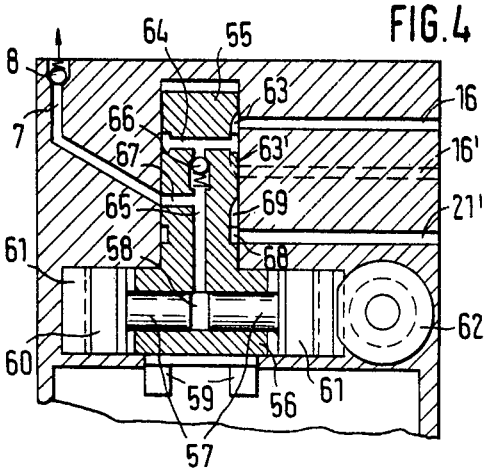
FIG. 4 shows a partial sectional view of another variant upon the first embodiment of the fuel injection pump according to the invention.
Figure 5:
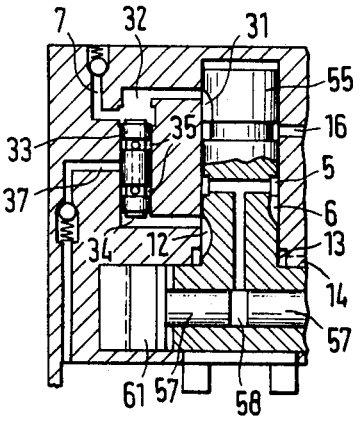
FIG. 5 shows a partial sectional view of still another variant upon the first embodiment of the fuel injection pump according to the invention.
Figure 6:
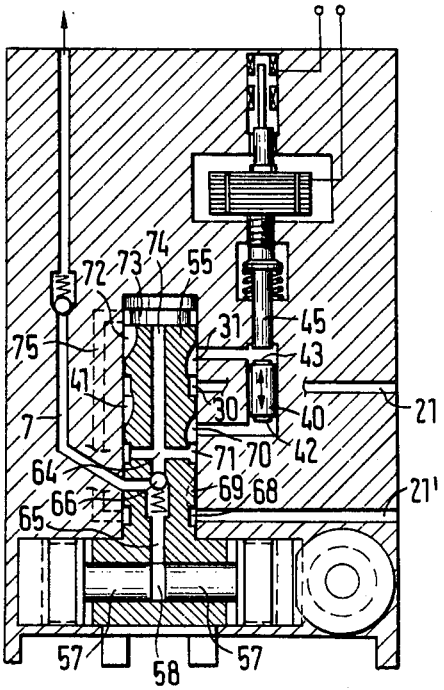
FIG. 6 shows a partial sectional view of a variant upon the second embodiment shown in FIG. 3.

In the pumps shown in FIGS. 4–6, variants are shown of the two embodiments shown in FIGS. 1–3. In these cases, instead of a pump and distributor piston as a unit, at least two radial pistons perform the pumping function, independently of the distributor, so that the distributor then executes only a rotary movement.

In these variants, the distributor 55 is provided with an enlarged, reinforced lower portion 56 in which are disposed radial pump pistons 57. A pump work chamber 58 is provided between the pistons 57. The distributor 55 is driven via projections 59, which are engaged by a drive shaft, not shown.

Referring to FIG. 4, the pistons 57 are driven via rollers 60 which roll off a cam ring 61, which in turn is easily rotatable, via an adjusting piston 62 engaging it tangentially, for the purpose of adjusting the onset of injection. The fuel metering is effected via the magnetic valve 20, 24 and the metering piston 25, 26, as shown in FIG. 1. During the intake stroke of the pump pistons 57, the fuel flows from the metering unit through the intake line 16, a distributor groove 63 in the distributor, a transverse bore 64 and a longitudinal bore 65 and into the pump work chamber 58. A check valve 66 is disposed in the longitudinal bore 65. During the compression stroke of the pump pistons 57, this metered fuel is delivered out of the pump work chamber 58 to the pressure line 7 by way of the longitudinal bore 65 and a distributor bore 67. The check valve 66 prevents the fuel from flowing back into the transverse bore 64 or into the longitudinal bore 63. In order to assure that the pressure line 7 will be under predetermined and uniform pressure, the pressure line 21 of the supply pump leads, with a branch line 21', to an annular groove 68 in the distributor; a longitudinal groove 69 branches off from the annular groove 68 and communicates with the pressure line 7 during the intake stroke of the pump pistons. This system functions in principle like that shown in FIG. 1. In order to assure that the refilling or reversal time of the metering unit is sufficient even in high-speed Diesel engines, a further metering system or even a multiplicity of metering systems may be coupled with one distributor, as indicated by broken lines in the drawing. Naturally, this is also applicable to the other exemplary embodiments of and variants upon the present invention This alternative possibility is indicated here only by a longitudinal groove 63' and a second intake conduit 16'. It is naturally also conceivable for these additional intake conduits 16' to be disposed in the same plane as the conduit 16, so that a single groove 63 can serve to open all of them.

In FIG. 5, a variant of this first exemplary embodiment is shown, corresponding to the variant shown in FIG. 2 and having an intermediate piston 33 disposed on the high-pressure side of the pump; in this case, however, a radial distributor pump is used. The description for FIG. 2 is thus directly applicable to FIG. 5 as well, with the difference being that instead of the compression or intake stroke of the piston 2 as in FIG. 2, there are two radial pistons 57 operating in FIG. 5.

A variant of the second exemplary embodiment shown in FIG. 3 is illustrated in FIG. 6. In contrast to the variant of FIG. 3, a distributor 55 which executes only a rotary movement is provided in this variant instead of the reciprocating piston distributor, and radial pistons 57 are provided to act as the pump piston. In terms of fuel measurement, what has already been said for FIG. 3 applies again in principle here. However, a further difference is that the pump work chamber is refilled with metered fuel not only during the upward movement of the intermediate piston 40 but also during its downward movement. The intermediate piston 40 begins its supply stroke intended for filling the pump work chamber not only in the lower outset position, but in the upper outset position, where it rests against the stop 45, as well. The longitudinal grooves 31 and 41 serve to refill the chambers adjacent to the extremities 43 and 42 of the intermediate piston 40. These longitudinal grooves 31 and 41 communicate with the annular groove 30, which is in constant communication with the pressure line 21 of the supply pump. As a result, upon each stroke of the intermediate piston 40, the quantity of fuel previously stored there is discharged to the pump work chamber 58. Thus during one intake stroke of the pump piston 57, the chamber adjacent to the extremity 42 of the metering piston 40 is connected via a longitudinal groove 70 with an annular groove 71, and further via the transverse bore 64 or longitudinal bore 65 leads to the pump work chamber 58 by way of an interposed check valve 66. During the next intake stroke of the injection pump, the metering or intermediate piston 40 is displced upward, and it thus forcing the fuel stored adjacent to the extremity 43 out via a longitudinal groove 72 and an annular groove 73 into an axial bore 74, which communicates with the axial bore 65 upstream of the check valve 66. The intermediate piston 40 is thus double-acting. Here again the annular groove 68, which communicates in turn by way of the line 21 with the supply pump pressure line 21 during the intake stroke, effects a uniform, low pressure in the pressure line 7.

Alternatively, by means of a certain modification of the variant shown in FIG. 6, the intermediate piston may also be embodied as single-acting. To this end, as is indicated by broken lines in FIGS. 6, a line 75 connecting the annular grooves 73 and 68 may be provided and the axial bore 74 may be eliminated. In this case, however, the pressure in the annular groove 68 must then be maintained lower than the pressure produced by the supply pump.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for a self-igniting internal combustion engine having a pump work chamber, said pump further having at least one metering piston functioning synchronously with the engine for determining a metered injection quantity, said pump further having a distributor driven synchronously with at least one pump piston, said distributor delivering said metered injection quantity to a work chamber during an intake stroke of said pump piston and to injection lines leading to the engine during a compression stroke of said pump piston, characterized in that said at least one metering piston confining volume of metered fuel is preferably disposed upstream of said distributor, said metering piston is actuated for its metering movement by a controlled fuel flow to said volume and is actuated for its displacement movement of the metered fuel to be fed into said pump work chamber by a controlled release of a restoring force means and further that the stroke of said metering piston is determined by electrical means, said electrical means being triggered by a control device whereby the metered injection quantity is determined, said electrical means comprising a travel transducer and a magnetic valve associated with said metering piston, and magnetic valve having a first position during the compression stroke when fuel is supplied from a supply pump to said metering piston and a second position at which a connection leading from the metered volume ahead of said metering piston to said pump work chamber is opened upon completion of the metering stroke of the metering piston, the connection being further controlled by a control edge of said pump piston and opened during the intake stroke when said metered injection quantity driven by the restoring force means is supplied to said work chamber.

2. A fuel injection pump for a self-igniting internal combustion engine having a pump work chamber, said pump further having at least one metering piston functioning synchronously with the engine for determining a metered injection quantity, said pump further having a distributor driven synchronously with at least one pump piston, said distributor delivering said metered injection quantity to a work chamber during an intake stroke of said pump piston and to injection lines leading to the engine during a compression stroke of said pump piston, characterized in that said at least one metering piston confining volume of metered fuel is preferably disposed upstream of said distributor, said metering piston is actuated for its metering movement by a controlled fuel flow to said volume and is actuated for its displacement movement of the metered fuel to be fed into said pump work chamber by a controlled release of a restoring force means and further that the stroke of said metering piston is determined by electrical means, said electrical means being triggered by a control device whereby the metered injection quantity is determined, said at least one metering piston comprising an intermediate piston adapted to effect a stroke, said pump further having a supply pump for delivering fuel under pressure to effect said stroke, said intermediate piston stroke having a limit position, said limit position being adjusted by an electrically actuated stop.

3. A fuel injection pump as defined by claim 1, characterized in that said pump includes an intermediate piston having two extremities, a first extremity adjacent to work chamber in which said metered injection quantity is stored downstream of said distributor, and a second extremity, controlled by said distributor, being arranged for selective communication with a relief conduit and said pump work chamber.

4. A fuel injection pump as defined by claim 3, characterized in that said intermediate piston is provided with face in which annular grooves are disposed, said pump includes a constantly pressurized suction chamber, said annular grooves serving to connect said injection lines to said suction chamber after said compression stroke terminates.

5. A fuel injection pump as defined by claim 2, further characterized in that said limit position is measured by means of a stroke transducer.

6. A fuel injection pump as defined by claim 2, further characterized in that said electrically adjusted stop comprises a servomotor.

* * * * *